United States Patent [19]

Kelly et al.

[11] 4,165,242

[45] Aug. 21, 1979

[54] TREATMENT OF METAL PARTS TO PROVIDE RUST-INHIBITING COATINGS BY PHOSPHATING AND ELECTROPHORETICALLY DEPOSITING A SICCATIVE ORGANIC COATING

[75] Inventors: Roger A. Kelly, Euclid; Howard G. Pekar, Mentor, both of Ohio

[73] Assignee: R. O. Hull & Company, Inc., Cleveland, Ohio

[21] Appl. No.: 853,238

[22] Filed: Nov. 21, 1977

[51] Int. Cl.[2] ..... C23F 7/10; C25D 13/06; C25D 13/20

[52] U.S. Cl. ..... 148/6.15 Z; 148/6.15 R; 204/181 R; 427/410; 427/417; 427/409; 427/334; 85/1 C; 85/10 F

[58] Field of Search ..... 148/6.15 Z, 6.15 R; 204/181 R, 181 C, 181 T; 427/417, 334, 409, 410, 242; 85/1 C, 10 F; 428/447

[56] References Cited

U.S. PATENT DOCUMENTS

| | | | |
|---|---|---|---|
| Re. 27,896 | 1/1974 | Rausch et al. | 204/181 |
| 2,986,482 | 5/1961 | Sharp | 148/6.15 |
| 3,104,177 | 9/1963 | Goldsmith | 148/6.15 |
| 3,118,793 | 1/1964 | Maloney et al. | 148/6.15 |
| 3,215,715 | 11/1965 | Wurstner | 260/429.9 |
| 3,333,988 | 8/1967 | Douty et al. | 148/6.15 |
| 3,370,992 | 2/1968 | Ilenda et al. | 148/6.16 |
| 3,450,579 | 6/1969 | Rausch | 148/6.16 |
| 3,454,483 | 7/1969 | Freeman | 204/181 |
| 3,502,511 | 3/1970 | Forsberg | 148/6.15 |
| 3,607,678 | 9/1971 | Wise | 204/181 |
| 3,620,949 | 11/1971 | Morrison et al. | 204/181 |
| 3,622,473 | 11/1971 | Ohata et al. | 204/181 X |
| 3,637,470 | 1/1972 | Hansen et al. | 204/181 X |
| 3,664,887 | 5/1972 | Atkiss | 148/6.16 |
| 3,697,306 | 10/1972 | Miller | 427/322 |
| 3,713,904 | 1/1973 | Bernath et al. | 148/6.16 |
| 3,864,230 | 2/1975 | Springer | 204/181 |
| 3,960,676 | 6/1976 | Miyosawa et al. | 204/38 A |
| 3,962,061 | 6/1976 | Nikaido et al. | 204/181 |
| 3,985,584 | 10/1976 | Chan et al. | 148/6.16 |
| 4,007,102 | 2/1977 | Springer et al. | 204/181 |

OTHER PUBLICATIONS

Poll, Products Finishing, Feb. 1973, pp. 34–43.

"The Polyseal System" Technical Bulletin, The Lubrizol Corp. (1970).

*Primary Examiner*—Ralph S. Kendall

*Attorney, Agent, or Firm*—Maky, Renner, Otto & Boisselle

[57] ABSTRACT

A method of treating metal parts to provide durable and rust-inhibiting coatings is described. The application method can be used to treat single parts or bulk barrel processing of parts. The method comprises the steps of (a) phosphating the metal parts with an aqueous metal phosphating solution, (b) electrophoretically depositing a siccative organic coating on the phosphated metal parts, and (c) applying a corrosion inhibiting film of oil as a seal coat.

21 Claims, No Drawings

TREATMENT OF METAL PARTS TO PROVIDE RUST-INHIBITING COATINGS BY PHOSPHATING AND ELECTROPHORETICALLY DEPOSITING A SICCATIVE ORGANIC COATING

BACKGROUND OF THE INVENTION

This invention relates to an improved metal treatment process, and more particularly, to a new and improved method for inhibiting the corrosion of metal articles. The invention relates particularly to the treatment of small metal parts and subassemblies to improve the corrosion resistance of such parts. The process can include treating single parts and bulk barrel processing of parts.

It is well known in the metalfinishing art that metal surfaces such as aluminum, ferrous, and zinc surfaces may be provided with an inorganic phosphate coating by contacting them with an aqueous phosphating solution. The phosphate coating protects the metal surface to a limited extent against corrosion and serves primarily as an excellent base for the later application of siccative organic coating compositions such as paint, lacquer, varnish, primers, synthetic resins, enamel, and the like.

The inorganic phosphate coatings generally are formed on a metal surface by means of aqueous solutions which contain phosphate ion and, optionally, certain auxiliary ions including metallic ions such as sodium, manganese, zinc, cadmium, copper, lead, and antimony ions. These aqueous solutions also may contain nonmetallic ions such as ammonium, chloride, bromide, fluoride, nitrate, sulfate, and borate ions. These auxiliary ions influence the reaction with the metal surface, modify the character of the phosphate coating, and adapt it for a wide variety of applications. Other auxiliary agents such as oxidizing agents, coloring agents, and metal cleaning agents also may be incorporated in the phosphating solution.

As mentioned above, the inorganic phosphate coatings have been found to provide an excellent base for the application of siccative organic coatings such as paints or lacquers. The provision of such phosphate coatings has been found to improve both the adhesion of the paint or lacquer film to the metal surface and the corrosion resistance of the painted metal.

Solvent-base siccative organic coating compositions have been applied to metal surfaces such as by spraying, dipping, rolling, centrifuged dip-spinning, etc. More recently, with the development of various water-soluble resin base paints and lacquers, a great deal of effort has been made toward the application of such coating systems by electrophoresis. The electrophoretic application of paint and lacquer involves the phenomena of electro-osmosis and electrolysis, as well as electrophoresis. In this method, an electric current is passed through the paint or lacquer solution while the article to be painted is made an electrode, usually the anode, in the paint or lacquer.

The electrodeposition of water-based coatings although widely used to process sheet metal parts, is not currently employed on subassemblies and barrel processing equipment for stamped parts such as nuts, bolts and fasteners. Electrodeposition for these parts has many advantages over other methods of coating. The process deposits a film of uniform thickness on essentially any conductive surface, even those which have sharp points and edges. The electrocoated film when applied is relatively water-free, and, thus, will not run or drip when taken out of the bath. Because little or no organic solvents are used in the coating system, the process does not require special precautions or equipment for handling any harmful solvent vapors.

Procedures for improving the rust resistance of metal articles by application of a film of paint over a phosphated surface have been described in a number of patents such as U.S. Pat. Nos. 3,620,949; 3,864,230; 3,454,483; 4,007,102 and Re. 27,896. As noted in U.S. Pat. No. Re. 27,896, the electrophoretic application of paint and lacquer over a phosphated metal surface is not a complete solution to the rust problem. It has been found that when paint is electrodeposited on phosphate coated ferrous metal surfaces, the resulting paint films have often been found to contain numerous small depressions or pin holes. Such films generally provide only a slight corrosion protective action, probably due to the presence of a lower film thickness in the depressions. In an attempt to overcome this problem, paints and lacquers have been used containing synthetic resin components which form films which during a subsequent baking will soften so that the surface blends smoothly and the depressions and pin holes are filled with resin. One difficulty with this technique, however, is that there often is a withdrawal of the paint film from the edges of the workpiece being treated so that these portions are then subjected to additional corrosion attacks. In U.S. Pat. No. Re. 27,896, a solution to this problem is suggested which involves the incorporation of cupric ions into the zinc phosphate coating applied to the article prior to painting. In U.S. Pat. No. 3,454,483, an improvement in the corrosion resistance of electrophoretically painted metal surfaces is suggested when the phosphate coating used as a primer for the paint contains fluoride ions.

SUMMARY OF THE INVENTION

A method for treating metal parts either singly or in bulk barrel processing to provide durable and rust-inhibiting coatings is described which comprises the steps of (a) treating the metal parts with an aqueous phosphating solution to deposit a phosphate coating thereon, (b) electrophoretically depositing a siccative organic coating on the phosphate coated metal parts, and (c) treating the siccative organic coated part with an oil to deposit a corrosion-inhibiting top coat.

DESCRIPTION OF THE PREFERRED EMBODIMENTS

The improved process of this invention can be utilized to improve the corrosion-inhibiting properties of metal surfaces such as aluminum, iron, steel and zinc surfaces and is useful particularly for bulk handling and treating small metal parts such as nuts, bolts and screws and subassemblies which otherwise are particularly difficult to rust-proof because of the difficulty of coating the more inaccessible areas of these parts such as the grooves between the threads, and the tendency of treated parts to nest together during treatment and curing.

The first essential step in the process of the invention is the treatment of the metal parts with an aqueous phosphating solution to deposit a phosphate coating thereon. The use of zinc, lead, iron and manganese phosphate solutions is preferred. It is well known in the metal finishing art to provide metal surfaces with an inorganic phosphate coating by contacting them with aqueous phosphating solutions. These aqueous solutions contain the phosphate ion and, optionally, certain auxiliary ions including metallic ions such as sodium, zinc, cadmium, iron, copper, lead, nickel, cobalt, calcium, magnesium, strontium, barium, and antimony ions, and non-metallic ions such as ammonium, chloride, bromide, nitrite, and chlorate ions. These auxiliary ions modify the character of the phosphate coating and adapt the solutions for a wide variety of applications.

The preparation and use of aqueous phosphating solutions is well known in the metal finishing art as shown by U.S. Pat. Nos. 1,206,075; 1,485,025; 2,001,754; 2,859,145; 3,090,709; 3,104,177; 3,307,979 and 3,458,364.

Aqueous phosphating solutions generally are prepared by dissolving in water, minor amounts of phosphoric acid, and, optionally, one or more metal salts such as nitrate, phosphate, nitrite, sulfate, chloride, or bromide of sodium, zinc, cadmium, iron, nickel, copper, lead, manganese or antimony. Ordinarily an oxidizing agent such as sodium chlorate, potassium perborate, sodium nitrate, sodium nitrite or hydrogen peroxide is included in the phosphating solution to depolarize the metal surface being treated and thereby increase the rate at which the phosphate coating is formed on the metal surface. Other auxiliary agents such as anti-sludging agents, coloring agents and metal cleaning agents also may be incorporated in the solution. One common type of commercial phosphating bath which contains zinc ion, phosphate ion and a depolarizer is made by dissolving small amounts of zinc dihydrogen phosphate, sodium nitrate and phosphoric acid in water.

In order to provide satisfactory coating weights and coating speeds, an aqueous phosphating solution generally should have a total acidity within the range of from about 5 to about 100 points, preferably from about 5 to about 50 points. It is possible, however, by certain special techniques known to those skilled in the art, to employ phosphating solutions having a total acidity slightly higher than 100 points, for example, 125, 200 or even 300 points or more. The term "points total acidity" as employed in the phosphating art represents the number of milliliters of 0.1 normal sodium hydroxide solution required to neutralize a 10 milliliter sample of a phosphating solution in the presence of phenolphthalein as an indicator.

Lead phosphate coatings, for example, can be deposited from aqueous phosphating solutions having a total acidity within the range of from about 5 to 850 points. These phosphating solutions generally will consist of from about 0.1% to about 40% of phosphate ion, from about 0.2% to about 55% of nitrate ion, from about 0.2 to about 30% of lead ion, and, optionally, a small amount of a halogen ion such as from about 0.001 to about 0.5% of chloride, bromide, fluoride or iodide ions. Such phosphating solutions as described in, for example, U.S. Pat. No. 3,364,081, are useful in the phosphating step of this invention and the disclosure of U.S. Pat. No. 3,364,081, is hereby incorporated by reference.

Preferably, the phosphate solution utilized in the first step of the method of the invention contains zinc ions thereby depositing a zinc phosphate coating on the metal parts. One example of a zinc phosphate solution which is useful in the present invention and deposits a dense, adherent, micro-crystalline or amorphous zinc phosphate coating of the metal parts is described in, for example, U.S. Pat. No. 3,090,709, which disclosure also is hereby incorporated by reference. The phosphating solutions described therein have a total acidity within the range of from about 5 to 100 points and contain as essential ingredients zinc ion, phosphate ion, nitrate ion and an ion selected from the group consisting of lithium, beryllium, magnesium, calcium, strontium, cadmium and barium ions. The micro-crystalline phosphate coating on the metal parts from such zinc phosphate solutions has a weight of at least about 25 milligrams per square foot of surface area and is preferably within the range of from about 100 to 1,000 milligrams per square foot of surface area.

The process of the invention also is useful in improving the rust inhibiting properties of metal parts which are initially coated with a heavier macro-crystalline zinc phosphate coating. Coating weights in the range of from about 1500 to 3000 milligrams per square foot of surface area can be applied to the metal parts prior to electrodeposition of the siccative organic coating. Such heavy macro-crystalline zinc phosphate coatings are obtained by treating the metal parts with an aqueous acidic bath containing zinc and phosphate ions but no alkaline earth metals. The current state of the art indicates that heavy macro-crystalline zinc phosphates are not to be used for electrodeposition of paint. Part of this invention utilizes the properties of these heavy coatings. The following example A illustrates the preparation of a typical zinc phosphate bath used for depositing a macro-crystalline zinc phosphate coating.

EXAMPLE A

A typical solution is prepared by dissolving 33.91 grams of 75% phosphoric acid, 18.03 grams of 42° Baume nitric acid, 14.11 grams of zinc oxide and 8.81 grams of zinc chloride in 25.06 grams of water. These typical solutions would be dissolved in water at 2–5% by volume to produce a workable phosphate bath.

In view of the extensive commercial development of the phosphating art and the many journal publications and patents describing the application of phosphating solutions, it is believed unnecessary to lengthen this specification unduly by a detailed recitation of the many ways in which the phosphating step in the process of the invention can be accomplished. It should be sufficient to indicate that any of the commonly used phosphating techniques such as spraying, brushing, dipping, roller-coating, or flow-coating may be employed, and that the temperature of the aqueous phosphating solution may vary within wide limits such as, for example, from room temperature to about 100° C. Generally, best results are obtained when the aqueous phosphating solution is used at a temperature within the range of from about 65° to about 100° C. If desired, however, the phosphating baths may be used at higher temperatures when employing super atmospheric pressures.

In the ordinary practice of phosphating a metal surface, the surface first is cleaned by physical and/or chemical means to remove any grease, dirt, or oxides, and then it is phosphated in the manner described above. Cleaning solutions are known in the art and generally are aqueous solutions containing sodium hydroxide, sodium carbonate, an alkali metal silicate, alkali metal metaborate, water softeners, phosphates, and surface active agents. Oxide removal is usually accomplished with mineral acid pickles such as sulfuric acid, hydrochloric acid, and phosphoric acid. This removal could be considered as supplemental cleaning.

The phosphating operation usually is carried out until the desired weight of the phosphate coating is formed on the metallic surface. The time required to form the coating will vary according to the temperature, the type of phosphating solution employed, the particular technique of applying the phosphating solution, and the coating weight desired. In most instances, however, the time required to produce the phosphate coating of the weight preferred for the purpose of the first step of the present invention will be within the range of from about 1 second to as long as 15 to 40 minutes depending on the type of phosphating solution. When the high total acid aqueous phosphating solutions are used, the immersion time is from about a few seconds to one to two minutes.

Specific examples of zinc phosphating solutions which yield phosphate coatings in accordance with the process of the invention are shown in Table I. The values indicated in the table are the percentages by weight of the ions in the aqueous phosphating solutions.

TABLE I

| | Zinc Phosphating Solutions | | | | |
|---|---|---|---|---|---|
| Ions | B | C | D | E | F |
| Zn | 0.52 | 0.48 | 0.33 | 0.15 | 0.5 |
| $PO_4$ | 1.29 | 1.22 | 0.83 | 0.53 | 1.3 |
| Ca | 0.27 | 0.85 | — | 0.36 | 0.5 |
| $NO_3$ | 1.41 | 5.36 | 0.93 | 1.3 | 1.7 |
| $NH_4$ | 0.14 | 0.13 | — | — | — |
| Cl | 0.22 | — | — | — | — |
| $ClO_3$ | — | — | — | — | 0.17 |
| Na | — | — | — | 0.062 | — |
| Other | — | — | — | 0.097[2] | — |
| PTA[1] | 30 | 30 | 20 | 12 | 25 |

[1]Points Total Acid
[2]Lactic acid anion

By way of illustration, phosphating solution B of Table I is prepared by dissolving in sufficient water to make one liter of solution, 14.2 gms of zinc nitrate hexahydrate, 7.8 gms of 75% phosphoric acid, 4.2 gms of zinc chloride, 8.7 gms of ammonium dihydrogen phosphate and 14.3 gms of calcium nitrate trihydrate.

Solution E is prepared by mixing 100 ml. of water, 7.4 gms of 75% phosphoric acid, 2.7 gms of 42° Baume nitric acid, 1.9 gms of zinc oxide and 2.2 gms of 50% aqueous sodium hydroxide. This mixture is diluted with water to make one liter of solution and 20 gms of calcium nitrate trihydrate and 1 gm of lactic acid are then dissolved in the solution.

Specific examples of lead phosphating solutions which can be utilized in the process of the invention are shown in Table II. Except for the "Points total acid" (PTA) the values given in the table indicate the percentages by weight of the various ions in the phosphating solution.

TABLE II

| | Lead Phosphate Solutions | | | |
|---|---|---|---|---|
| Ions | G | H | I | J |
| Pb | 2.92 | 5.09 | 4.12 | 8.22 |
| $PO_4$ | 0.851 | 11.12 | 2.27 | 4.52 |
| $NO_3$ | 6.33 | 25.20 | 8.97 | 18.00 |
| Cl | 0.058 | 0.077 | — | 0.124 |
| F | — | — | 0.007 | — |
| PTA | 110 | 608 | 157 | 254 |

By way of illustration, solution G is prepared as follows. To 640 parts of water there is added 219 parts of 70% nitric acid and 24.6 parts of 85% phosphoric acid. The mixture is stirred and 80.4 parts of lead oxide are added. The stirring is continued until all of the lead oxide is in solution whereupon 1.5 parts of sodium chloride in one part of iso-octo phenyl polyethoxyethanol (wetting agent) are added. The working solution is prepared by adding 1,425 parts of water to the above solution.

The phosphating solution H having a total acidity of 608 points is prepared from a concentrate obtained by adding 204 parts of 70% nitric acid, 54.5 parts of potassium nitrate and 53.3 parts of 85% phosphoric acid to 540 parts of water. The mixture is stirred and 86 parts of lead oxide is added followed by the addition of 2 parts of sodium chloride. To 230 parts of the above concentrate in 84 parts of water, there is added 70 parts of 85% phosphoric acid to form solution G.

After the desired contact between the surfaces to be treated and the phosphate solution has been effected for the desired period of time, the phosphated article preferably is rinsed, optionally, with water to remove any of the acidic coating solution which may remain on the surface. Preferably, a hot water rinse is used with water temperatures within a range of from about 50° to about 100° C. As with the application of the phosphate coating solution, various contacting techniques may be used, with rinsing by dipping or spraying being preferred.

In addition to or in place of the water rinse, the phosphated article can be rinsed with a hot dilute aqueous solution of chromic acid containing trivalent or hexavalent chromium calculated as $CrO_3$, typically in an amount within the range of from about 0.01 to about 1% by weight of the solution. The chromic acid rinse appears to "seal" the phosphate coating and improve its utility as a base for the application of the siccative organic coating.

Various water-soluble or water-dispersable sources of hexavalent chromium may be used in formulating the rinsing solution, provided the anions and the cations introduced with the hexavalent chromium do not have a detrimental effect on either the solution itself, the coated surfaces treated or the subsequently applied paint composition. Exemplary of hexavalent chromium materials which may be used are chromic acid, the alkali metal and ammonium chromates, the alkali metal and ammonium dichromates, the heavy metal chromates and dichromates such as those of zinc, calcium, chromium, ferric ion, magnesium, and aluminum. Chromic acid-phosphoric acid mixtures, mixtures of hexavalent and trivalent chromium, as well as completely trivalent chromium mixtures, also can be utilized. A typical chrome rinse solution can be prepared, for example, by dissolving 38.4 grams of chromic acid and 12.9 grams of hydrated line in 48.7 grams of water. The working bath is prepared by adding approximately 1 pint of the solution above to 100 gallons of water.

The chromium rinse solution can be applied to the coated metal surfaces using various techniques including immersion, flooding, spraying, etc. Generally, it is preferred that the aqueous chromium containing rinse solution is maintained at an elevated temperature while it is contact with the phosphate coated metal surface. Temperatures in the range of from about 30° to 100° C. and contact times of up to about thirty seconds or two minutes are typical. Following the application of the chromium containing rinse solutions, the treated metal surfaces preferably may again be rinsed with water so as to remove any of the acidic rinse solution which may remain on the surface.

After the metal article has been phosphated in accordance with the procedure described above and optionally given a chrome rinse, a protective film of a siccative organic coating composition is applied by the electrophoretic process of painting metal surfaces.

In the electrophoretic process, the metal article to be coated is placed in an electrolytic solution which contains water-emulsified colloidal paint particles. The phosphate coated metal surface to be painted may be either the anode or the cathode, depending on the characteristics of the paint which is used.

The electrophoretic application of the paint may be carried out in various ways as are known to those skilled in the art. Typically, an electric charge is passed through both the metal surface and the water-based paint by placing a positive charge on the metal surface which acts as an electrode, and a negative charge on the second electrode, generally the container of the paint. An alternative method would be to charge the container or parts with a positive charge, which acts as an electrode transmitting its charge to the parts. In this electric field, the colloidal particles of the paint which are in suspension move either toward the negative or positive electrode depending on the charge carried by the dispersed particles. In the present situation, namely, the metal surface having a positive charge, negative paint particles are attracted to the metal surface of the parts. Upon contact with the metal surface of the parts, the colloidal particles lose their electrical charge, thereby breaking the emulsion and depositing as a coating on the electrode. The metal article or container of metal articles is then removed from the solution, rinsed, and baked in an oven to cure the deposited coating.

The electrical potential applied in the process of electrophoresis is determined by the desired thickness of the coating, the conductivity and the composition of the coating bath, and the time allotted for the formation of the coating. Voltages of from about 50 to 1000 volts have proven satisfactory at a current density of from about 0.1 to about 7 amperes per square foot. Normally, the coating solution is at substantially room temperature, but elevated temperatures, for example, from 20° to 40° C. and even higher, may be used if desired. The deposition process requires about 10 seconds to about 10 minutes.

The electrolytic solutions which are utilized in the electrophoretic coating process of the invention generally comprise water emulsions or dispersions of paint particles in a colloidal state, or the paint may be aqueous solutions based on synthetic resins such as alkyd resins, acrylic polymers, melamine resins, epoxy resins, phenolic resins, and polyvinyl alcohol resins. These aqueous resin solutions generally will have a pH of about 9 for anodic application and about pH 5 for cathodic paints, and the solvent used is either water or an aqueous alcoholic mixture. The siccative organic coating solutions may be either paints or lacquers, i.e., they may be either pigmented or unpigmented.

The siccative organic coating compositions which may be utilized in the invention contain highly polar resins and principally thermosetting resins which may be, for example, an acrylic resin such as acrylic acid resin, an acrylate resin or acrylamide resin, or a reaction product or a mechanical mixture of an alkyd resin in a water-soluble melamine resin or a vinyl-modified unsaturated alkyd resin and a water-soluble melamine resin. An example of a water-soluble melamine resin is one obtained from hexamethylol melamine hexaalkylether. The vinyl modified unsaturated alkyd resins can be made by polymerization of a vinyl monomer with an alkyd resin composed of an unsaturated oil or fatty acid. In this application, the term "vinyl monomer" is intended to mean a monomer having a vinyl group ($-CH=CH_2$) in the molecule, such as an acrylic ester, for example, methyl acrylate and ethyl acrylate; a methacrylic ester such as methylmethacrylate; an unsaturated organic acid such as acrylic acid and methacrylic acid; and styrene.

The above-mentioned thermosetting acrylic resins may be made by heating and stirring a mixture consisting of organic solvents such as methanol, ethylene glycol monobutyl ether and/or cyclohexanone, unsaturated organic acids such as acrylic acid, methacrylic acid and/or maleic anhydride, a cross-linking vinylmonomer (as defined above) such as methylol-acrylamide and/or methylol methacrylamide, a polymerizable vinyl monomer (as hereinabove defined) such as styrene and/or acrylic acid ester, polymerization catalysts such as benzoyl peroxides and/or lauroyl peroxides, and polymerization regulators such as dodecyl mercaptan and/or carbon tetrachloride, to carry out polymerization, thereafter neutralizing the product with, for example, an aqueous solution of ammonia and/or triethylamine to make the resin soluble in water.

Thermosetting resins composed of alkyd resins and water-soluble melamine resin obtained from hexamethylol melamine hexaalkyl ether, may be obtained by mixing a water-soluble melamine resin at a temperature of from room temperature to 100° C. with an alkyd resin modified with a fatty acid, the alkyd resin having an acid value of from 10 to 80 and an oil length of from zero to 80 percent, and being obtained by heating a mixture consisting of (1) a saturated or unsaturated aliphatic acid, (2) ethylene glycol, glycerol, polyethylene glycol, other polyhydric alcohol or an epoxide, (3) adipic acid, sebacic acid, maleic anhydride or other polybasic acid or anhydride, and (4) a small quantity of cyclohexanone, toluene or other organic solvent.

Alternatively the thermosetting resin may be obtained by mixing a water-soluble melamine resin and an alkyd resin from the ester exchange process, the resin being obtained by esterifying a mixture of dehydrated castor oil, an above-mentioned polyhydric alcohol and a small amount of an ester exchanging catalyst such as caustic potash, and thereafter esterifying also an above-mentioned polybasic acid or anhydride.

Thermosetting resins consisting of a modified acrylic resin and a water-soluble melamine resin, obtained from hexamethylol melamine hexaalkyl ether, may be obtained by polymerizing by heating and stirring a mixture consisting of organic solvents such as methanol, ethylene glycol mononutyl ether and/or cyclohexanone, unsaturated acids such as acrylic acid and/or methacrylic acid, a vinyl monomer (as hereinabove defined), such as styrene and/or acrylicacid ester, a cross-linking vinyl monomer, if necessary, such as methylol acrylic amide or glycidyl methacrylate and polymerization catalysts and/or polymerization regulators, thereby obtaining a modified acrylic polymer; mixing said modified acrylic polymer with a water-soluble melamine resin, which is obtained from hexamethylol melamine hexaalkyl ether and heating at a temperature under 100° C.; making it soluble in water by neutralizing with, for example, an aqueous solution of ammonia and/or triethylamine or by treating the acrylic polymer with, for example, ammonia and thereafter mixing with water-soluble melamine at ambient temperature.

A thermosetting vinyl modified unsaturated alkyd resin may be obtained by dissolving an unsaturated alkyd resin in methanol, ethylene glycol-monobutyl ether or other suitable organic solvent and performing a graft copolymerization with a mixture consisting of unsaturated organic acid(s) such as acrylic acid and/or methacrylic acid, vinyl monomer(s) such as styrene, methacrylic acid ester and/or acrylic acid ester, cross-linking monomer(s) such as methylol acrylic amide if necessary, and peroxide polymerization catalyst(s) and/or polymerization regulator(s), and thereafter neutralizing the thus obtained vinyl modified unsaturated alkyd resin with an aqueous solution of ammonia, for example, to make it soluble in water.

Further, with regard to the resins composed of vinyl modified unsaturated resin(s) and water-soluble melamine resin(s), obtained from hexamethylol melamine hexaalkyl ether, the thermosetting resins may be obtained by heating and mixing the foregoing vinyl modified unsaturated alkyd resin(s) at a temperature below 100° C., and making it soluble in water by neutralizing it with, for example, an aqueous solution of ammonia; or they may be obtained by rendering the said vinyl modified unsaturated alkyd resin(s) soluble in water by neutralizing with, for example, an aqueous solution of ammonia, and thereafter mixing it with the water-soluble melamine resin(s) at ambient temperature.

Water solutions and dispersions of thermosetting resins in paint formulations are available commercially from a variety of sources and these may be further diluted or concentrated as desired.

In preparing a dispersion, emulsion or solution of the thermosetting resin, the concentration of the resin is selected depending on the conditions to be employed, but a concentration of resin of from 3 to 40 percent by weight is normally used. The best results are obtained when using a concentration of resin of from 5 to 25 percent by weight and by regulating the voltage and the initial current density within a safe and economical range.

A typical procedure for electrocoating small metal parts in accordance with this invention comprises placing the parts to be treated in a rotatable, porous barrel and processing the barrel of parts through the cleaning, phosphating, and optional chromic rinse. This same barrel of phosphated parts is then immersed in the electrocoat paint either after drying the parts, or while still wet.

The barrel of parts is rotated intermittently for five minutes at about 25°–30° C. and a voltage of 250–350 volts and 5 amps. The number of rotation cycles employed, may be varied depending upon the type of parts, and quantity of parts in the barrel.

The parts then are removed from the barrel, water rinsed, and baked. Alternatively, the painted parts may be rinsed while still in the barrel, another unique method of this invention.

Generally the barrel is fabricated of 316 SS so that it may be employed throughout the coating cycle including the phosphate treatment and painting process. The sides of the barrel should be of ⅛" to ½" mesh to allow proper solution flow during both phosphating and painting.

At times it may be desirable to employ additional electrodes within the barrel to improve current flow, although normally the barrel itself provides sufficient electrode area.

Optionally the barrel may be constructed of plastic and lined with 316 SS screen to provide sufficient electrode area.

The resin electrodeposited on the phosphate coating in the manner mentioned above is baked at a temperature sufficient to cause cross-linking of the thermosetting resin(s) and produce a dry finish. Usually, a suitable temperature is from 90° to 600° C., but a temperature of from 120° to 200° C. is preferred, for a period of from 1 to 60 minutes. Such deposited siccative coatings exhibit excellent adhesive properties to the phosphated metal parts. The electrodeposited coating selected should not have good cohesive properties, otherwise coated parts will stick together during coating or baking. The thickness of the resin or paint film (coating) on the phosphated metal can be from about 0.2 to 20 mils or more although in the process of the present invention, film thicknesses between about 0.5 to 0.7 mil are quite satisfactory.

Although the metal parts which have been phosphated and electrocoated with a siccative organic coating in the manner described above exhibit improved resistance to corrosion, it has been found that the inhibition of corrosion of the metal parts can be further increased by applying a seal coating of a rust inhibiting oil. This seal coating can be of a straight undiluted oil such as any oil which is liquid or soluble in a solvent under the conditions of application. Examples of such oils include kerosene, fuel oil, gas oil, synthetic oils such as dioctyl adipate and dinonyl sebacate and naturally occurring oils such as castor oil, olive oil, sesame seed oil or mineral oils. Mineral oils are preferred because of their low cost and availability. Generally the oils will be fluid oils ranging in viscosity from about 40 Saybolt Universal seconds at 38° C. to about 200 Saybolt seconds at about 100° C.

The oils may be mixed with organic solvents including those used in the paint and lacquer industries, such as xylene, mesitylene, benzene, aromatic petroleum spirits, lauryl alcohol, dianyl naphthalene, dicapryl diphenyl oxide, didodecyl benzene, methyl isobutyl ketone and chloronated alkanes such as ethylene dichloride and 1,2-dichloropropene. Mixtures of these solvents are useful. On drying the seal coating, the more volatile solvents evaporate and leave a seal coating of oil as a rust-inhibiting film.

The oil seal coating can be applied as an emulsified water:oil mixture containing wetting or surface active agents followed by drying to remove the water. One advantage of the water:oil mixtures is that no hazardous organic solvents are involved in the process.

The oil which is applied as the top seal coat also may contain other compositions which improve the rust-inhibiting properties of the oil. Compositions which are known in the art may be included in the oil to be applied as the seal coat, generally in amounts up to about 20–25% or higher. One example of a preferred type of additive composition is metal-containing phosphate complexes such as can be prepared by the reaction of (a) a polyvalent metal salt of the acid phosphate esters derived from the reaction of phosphorus pentoxide with a mixture of monohydric alcohol and from about 0.25 to 4.0 equivalents of a polyhydric alcohol, with (b) at least about 0.1 equivalent of an organic epoxide. Thin films of these complexes in oil over the phosphated and painted metal parts are effective in inhibiting the corrosion of the metal surfaces.

These types of metal-containing phosphate complexes which are contemplated as being useful in the process of the invention are described in U.S. Pat. No. 3,215,715, and the disclosure of the patent is hereby incorporated by reference.

In general, the acid phosphate esters required for the preparation of starting material (a) are obtained by the reaction of phosphorus pentoxide with a mixture of a monohydric alcohol and a polyhydric alcohol. The precise nature of the reaction is not entirely clear, but it is known that a mixture of phosphate esters is formed.

The monohydric alcohols useful in the preparation of starting materials (a) are principally the non-benzenoid alcohols, that is, the aliphatic and cycloaliphatic alcohols, although in some instances aromatic and/or heterocyclic substituents may be present. Suitable monohydric alcohols include propyl, isopropyl, butyl, amyl, hexyl, cyclohexyl, methylcyclohexyl, octyl, tridecyl, benzyl and oleyl alcohols. Mixtures of such alcohols also can be used if desired. Substituents such as chloro, bromo, nitro, nitroso, ester, ether, keto, etc. which do not prevent the desired reaction also may be present in the alcohol. In most instances, however, the monohydric alcohol will be an unsubstituted alkanol.

The polyhydric alcohols useful in the preparation of starting materials (a) are principally glycols, i.e., dihydric alcohols, although trihydric, tetrahydric and higher polyhydric alcohols may be used. In some instances, they may contain aromatic and/or heterocyclic substituents as well as other substituents such as chloro, bromo, nitro, ether, ester, keto, etc. Examples of suitable polyhydric alcohols include ethylene glycol, diethylene glycol, triethylene glycol, propylene glycol, 1,3-butanediol, glycerol, glycerol monooleate, mono-benzylether of glycerol, pentaerythritol and sorbitol dioctanoate. Mixtures of these polyhydric alcohols can be used.

The reaction between the alcohol mixture and the phosphorus pentoxide is exothermic and can be carried out conveniently at a temperature ranging from room temperature or below to a temperature just below the decomposition point of the mixture. Generally temperatures within a range of from about 40° to about 200° C. are satisfactory. The reaction time varies according to the temperature and to the reactivity of the alcohols. At higher temperatures as little as 5 or 10 minutes may be sufficient for complete reaction, while at room temperature, 12 or more hours may be required.

The reaction may be conducted in the presence of an inert solvent to facilitate mixing and handling. Typical solvents include petroleum aromatic spirits boiling in the range of 120°–200° C., benzene, xylene, toluene, and ethylene dichloride. In most instances, the solvent is allowed to remain in the acid phosphate esters and ultimately in the final metal-containing organic phosphate complex which serves as a vehicle for the convenient application of films to the painted articles.

The conversion of the acid phosphate esters to the polyvalent metal salt can be carried out by any of the usual methods for preparing salts of organic acids. The polyvalent metal of starting material (a) may be any light or heavy polyvalent metal such as zinc, cadmium, lead, iron, cobalt, nickel, barium, calcium, strontium, magnesium, copper, bismuth, tin, chromium, or manganese. The polyvalent metals of group II of the periodic table generally are preferred. One example of a highly effective starting material (a) is the zinc salt of the acid phosphate esters formed by the reaction of a mixture of equivalent amounts of isooctyl alcohol and dipropylene glycol with phosphorus pentoxide.

As mentioned above, the complex is obtained by reacting the polyvalent metal salts (a) with (b) an organic epoxide. Organic epoxides containing at least one

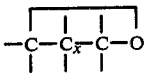

linkage where x is zero or a small integer, suitable for the purpose of this invention include the various substituted and unsubstituted alkylene oxides containing at least two aliphatic carbon atoms, such as, e.g., ethylene oxide, 1,2-propylene oxide, 1,3-propylene oxide, 1,2-butylene oxide, pentamethylene oxide, hexamethylene oxide, 1,2-octylene oxide, cyclohexene oxide, styrene oxide, alpha-methyl styrene oxide, beta-propiolactone, methyl epoxycaprylate, ethyl epoxypalmitate, and epoxidized soyabean oil. Of the various available organic epoxides, it is preferred to use those which contain at least 12 carbon atoms. Especially preferred are those epoxides which contain at least 12 carbon atoms and also a carboxylic ester group in the molecule. Thus, the commercially available epoxidized carboxylic ester, butyl epoxystearate, is very satisfactory as starting material (b) for the purpose of this invention. If desired, the organic epoxide may also contain substituents such as chloro, bromo, fluoro, nitro, nitroso, ether, sulfide and keto, in the molecule.

Complexes prepared using as little as 0.1 or 0.25 equivalent or as much as 1.5 or 2 or more equivalents of the organic epoxide per equivalent of polyvalent metal salt are satisfactory for the purpose of this invention. For reasons of economy and optimum corrosion inhibition, however, it is generally preferred to use about equivalent amounts of the two starting materials.

The reaction between the organic epoxide and the polyvalent metal salt of the acid phosphate esters is only slightly exothermic, so in order to insure complete reaction some heat generally is supplied to the reaction mass. The time and temperature for this reaction are not particularly critical; satisfactory results may be obtained by maintaining the mass for 0.5–6 hours at a temperature within the range of from about 40° C. to about 150° C. Ordinarily the product is clear and does not require filtration. In some instances, however, it may be desirable to filter the product, particularly when the polyvalent metal salt starting material has not been purified.

The following examples illustrate some of the types of metal-containing organic phosphate complexes which can be incorporated into the seal coat in accordance with the procedures described above.

EXAMPLE 1

49 parts (0.73 equivalent) of dipropylene glycol, 95 parts (0.73 equivalent) of isooctyl alcohol, and 133 parts of aromatic petroleum spirits boiling in the range 316°–349° F. are introduced into a reaction vessel. The whole is stirred at room temperature and 60 parts (0.42 mole) of phosphorus pentoxide is introduced portionwise over a period of about 0.5 hour. The heat of reaction causes the temperature to rise to about 80° C. After all of the phosphorus pentoxide has been added, the whole is stirred for an additional 0.5 hour at 93° C. The resulting acid phosphate esters show an acid number of 91 with bromphenol blue as an indicator.

The mixture of acid phosphate esters is converted to the corresponding zinc salt by reacting it with 34.5 parts of zinc oxide for 2.5 hours at 93° C. Thereafter 356 parts (one equivalent per equivalent of zinc salt) of butyl epoxystearate is added to the zinc salt at 88° C. over a period of about one hour and the whole is stirred for 4 hours at 90° C. Filtration of the mass yields 684 parts of a zinc-containing organic phosphate complex having the following analysis:

| | |
|---|---|
| Percent phosphorus | 3.55 |
| Percent zinc | 3.78 |
| Specific gravity | 1.009 |

EXAMPLE 2

A cadmium-containing organic phosphate complex is made in the manner set forth in Example 1, except that 54.5 parts of cadmium oxide is used in lieu of the specified amount of zinc oxide.

EXAMPLE 3

520 parts (4 equivalents) of isooctyl alcohol, 268 parts of dipropylene glycol (4 equivalents), and 1031 parts of toluene solvent are introduced into a reaction vessel. The whole is stirred and 243 parts (1.71 moles) of phosphorus pentoxide is added portionwise over a period of 2 hours. The exothermic character of the reaction causes the temperature to rise from room temperature to 60° C. To insure complete reaction, the whole is stirred for an additional 4 hours at 60° C. The resulting 50% solution of the acid phosphate esters in toluene shows an acid number of 88 with bromphenol blue as an indicator.

1000 parts of the toluene solution of acid esters is converted to the corresponding zinc salt by reaction with 83 parts of zinc oxide for 5.5 hours at 40°–45° C. Filtration yields a clear, light-yellow toluene solution of the zinc salt. 360 parts of this toluene solution (containing 0.34 equivalent of zinc salt) is heated with 25 parts (0.34 equivalent) of beta-propiolactone for 5.5 hours at 50°–60° C. to yield the desired zinc-containing organic phosphate complex as a 55% solution in toluene. It has the following analysis:

| | |
|---|---|
| Percent phosphorus | 4.26 |
| Percent zinc | 5.05 |

EXAMPLE 4

A zinc-containing organic phosphate complex is made in the manner set forth in Example 1, except for the following differences: 58 parts of 1,2-propylene oxide is used in lieu of the butyl epoxystearate and the reaction between the zinc salt of the acid phosphate esters and the 1,2-propylene oxide is carried out at 30°–35° C. rather than 88°–90° C.

EXAMPLE 5

A zinc-containing organic phosphate complex is made in the manner set forth in Example 1, except that 136 parts (0.73 equivalent) of lauryl alcohol and 39 parts (0.73 equivalent) or diethylene glycol are used in lieu of the specified amounts of isooctyl alcohol and dipropylene glycol.

Examples of oils and oil:water emulsions containing a metal containing organic phosphate complex of the type described above are as follows.

EXAMPLE 6

An oil mixture is prepared containing 60 parts of mineral oil, 2 parts of triethanolamine, 3 parts of oleic acid, 15 parts of a sodium sulfonate wetting agent and 20 parts of the product of Example 1.

EXAMPLE 7

The mixture of this example comprises 65 parts of mineral oil, 2 parts of triethanolamine, 3 parts of oleic acid, 15 parts of the product of Example 4 and 15 parts of a sodium sulfonate wetting agent.

EXAMPLE 8

An emulsion is prepared by vigorously mixing 20 parts of the oil of Example 6 with 80 parts of water.

EXAMPLE 9

An emulsion is prepared by vigorously mixing 15 parts of the oil mixture of Example 7 with 85 parts of water.

The above described oil top coat treatment is applied to the articles immediately after the siccative organic coating is subjected to the baking operation. As a practical matter, the oil application, preferably, the water-oil emulsion or dispersion can be utilized as a quench after the baking operation.

The following examples illustrate embodiments of the overall process of this invention and the advantages obtained from the process. Heat treated, 1050 steel spring fastener pieces are placed in a stainless steel barrel which is immersed in the zinc phosphate solution of Example A for a period of about 15 minutes at about 80° C., rinsed in water at room temperature and immersed in a chromic acid solution containing hexavalent chromium for about one minute at about 82° C. After drying the chrome rinsed parts, the barrel is immersed in a stainless steel paint tank. The barrel has a power connection to the positive side of a rectifier and insulated cathodes are submerged in the tank around the barrel. In this example the paint in the tank is a commercially available (Parr Inc.) water reducible epoxy ester resin pigmented black. The barrel is rotated intermittently and current is applied as indicated below in Table III. The paint temperature is about 28° C. The parts are removed from the paint tank, water rinsed, and heated in an oven for about 15 minutes at about 175° C. to cure the paint. As the parts are removed from the oven, one of each type is quenched by immersion in the oil:water mixture of Example 8, and thereafter air dried.

It has been found that when small metal parts such as steel U-bolts and spring clamps are treated in accordance with the procedure of the invention, improved rust inhibition is observed. The improvement is demonstrated when treated test pieces are subjected to Salt Fog Corrosion tests (ASTM Procedure designation B117-57T). In this procedure, the coated parts are suspended in a salt fog cabinet, and a 5% sodium chloride solution is sprayed onto the parts at about 38° C. for a period of up to about 264 hours or more, and the parts are periodically examined for the appearance of rust, primarily pinpoint rust. Satisfactory results are obtained when only one coat of siccative organic coating composition is applied in between the application of the phosphate and the oil seal coat. Moreover, improved corrosion resistance is observed when the metal parts treated in accordance with the process of this invention are compared to metal parts which have been treated by a similar process except that the same siccative composition is applied without current, that is, is not electrodeposited. Improved corrosion resistance also results due to the presence of the final oil top coat. The results of the Salt Fog Corrosion test conducted on parts treated in accordance with the invention compared to parts without the oil top-coat are summarized in Table III. Ten pieces from each treatment are subjected to the test. The improved results obtained by the method of the present invention are apparent.

TABLE III

SALT FOG TEST

| Test | Paint application[1] Time | Oil of Example 8[2] | Test Results (10 pieces) 168 hrs. | 264 hrs. |
|---|---|---|---|---|
| SF-1 | 90 sec. | No | Pinpoints | 5–1% Rust 2–2% Rust 3–5% Rust |
| SF-1A | 90 sec. | Yes | OK | OK |
| SF-2 | 5 min. | No | Pinpoints | 8–2% Rust 1–5% Rust 1–10% Rust |
| SF-2A | 5 min. | Yes | OK | OK |

[1]Parr Epoxy at 225 volts
[2]Parts immersed at 65° C. for 1 minute

We, therefore, particularly point out and distinctly claim as our invention:

1. A method of treating metal parts to provide a durable rust-inhibiting coating comprising the steps of
   (a) phosphating the metal parts with an aqueous metal phosphating solution,
   (b) electrophoretically depositing a siccative organic coating on the phosphated metal parts contained in a rotatable porous barrel, and
   (c) applying a corrosion inhibiting film of oil as a seal coat.

2. The method of claim 1 wherein the aqueous metal phosphating solution is an aqueous acidic zinc, lead, iron or manganese phosphating solution.

3. The method of claim 1 wherein the phosphated metal part obtained in step (a) is rinsed with an aqueous acidic solution containing chromium prior to step (b).

4. The method of claim 3 wherein the rinse solution contains hexavalent chromium, and the rinsed phosphated metal is dried prior to the electrophoretic treatment of step (b).

5. The method of claim 3 wherein the rinse solution contains hexavalent chromium, and the rinsed phosphated metal is not dried prior to the electrophoretic treatment of step (b).

6. The method of claim 1 wherein the electrophoretic deposition of the organic coating is carried out at a voltage within the range of from about 50 to 1000 volts, at temperatures of from about 20°–40° C., and for a period of time from about 10 seconds to 10 minutes.

7. The method of claim 1 wherein prior to phosphating the metal part, the surface is cleaned by contact with an aqueous cleaning solution containing an alkali metal silicate and an alkali metaborate.

8. The process of claim 1 wherein the siccative organic coating composition is electrophoretically deposited on the phosphated surface by immersing said parts in an aqueous dispersion, emulsion or solution of a thermosetting resin and passing through said metal as an anode, a direct current having an initial voltage of from about 200 to 300 volts at about 4–5 amperes, and thereafter curing the resin by heating at a temperature of from about 120°–250° C.

9. The method of claim 8 wherein the concentration of the resin in said aqueous dispersion, emulsion or solution is from about 3 to 40% by weight.

10. The method of claim 8 wherein a pigment or dye is incorporated into said resin dispersion, emulsion or solution.

11. The method of claim 1 wherein the siccative organic coating composition comprises a polar resin containing at least one member of the group consisting of epoxy resins, melamine-formaldehyde resins, alkyd resins, polyester resins, acrylic resins, polybutadiene resins and natural resins.

12. The method of claim 1 wherein the oil applied in step (c) is a mineral oil which contains a metal-containing organic phosphate complex prepared by the process which comprises the reaction of (a) a polyvalent metal salt of the acid phosphate esters derived from the reaction of phosphorus pentoxide with a mixture of a saturated aliphatic or cycloaliphatic monohydric alcohol containing from about 3 to about 18 carbon atoms, and from 0.25 to 4 equivalents of a polyhydric alcohol having from 2 to 4 hydroxyl groups and containing from about 2 to about 41 carbon atoms with (b) at least about 0.1 equivalent of an organic epoxide.

13. The method of claim 12 wherein the metal salt is a zinc salt.

14. A method of producing an adherent and rust-inhibiting finish on metal parts selected from the group consisting of ferrous metal, zinc, aluminum and alloys thereof comprising the steps of
   (a) immersing the parts in an aqueous acidic zinc, lead, iron or manganese phosphating solution for a period of time and at a temperature sufficient to deposit an adherent phosphate coating on said metal parts,
   (b) rinsing the phosphate coated parts with an aqueous acidic solution containing hexavalent chromium,
   (c) immersing the phosphate coated metal parts contained in a rotatable porous barrel in an aqueous dispersion, emulsion or solution of a thermosetting resin and passing through said part, an electric current thereby electrodepositing resin particles on the phosphate-coated parts by electrophoresis to form a resin film,
   (d) curing the resin film by subjecting the parts to a temperature of from about 120°–250° C. for 5 to 30 minutes,
   (e) immersing the cured resin coated parts in oil to form a top seal coat of the oil, and
   (f) drying the oil-coated parts.

15. The method of claim 14 wherein the metal parts are immersed in step (a) in an aqueous acid zinc phosphating solution.

16. The method of claim 14 wherein the concentration of the thermosetting resin in the aqueous dispersion, emulsion, solution is from about 3 to 40%.

17. The method according to claim 14 wherein the temperature of the resin dispersion, emulsion or solution is maintained at 10°–30° C.

18. The method of claim 14 wherein the oil is a mineral oil which contains a metal-containing organic phosphate complex prepared by the process which comprises the reaction of (a) a polyvalent metal salt of the acid phosphate esters derived from the reaction of phosphorus pentoxide with a mixture of a saturated aliphatic or cycloaliphatic monohydric alcohol containing from about 3 to about 18 carbon atoms, and from 0.25 to 4 equivalents of a polyhydric alcohol having from 2 to 4 hydroxyl groups and containing from about 2 to about 41 carbon atoms with (b) at least about 0.1 equivalent of an organic epoxide.

19. The method of claim 18 wherein the polyvalent metal salt of (a) is a zinc salt.

20. The method of claim 18 wherein the organic epoxide of (b) is an epoxy alkane containing at least about 12 carbon atoms.

21. The method of claim 18 wherein the metal containing phosphate complex is prepared by the process which comprises the reaction of (a) a zinc salt of the acid phosphate esters derived from the reaction of phosphorus pentoxide with a mixture of iso-octyl alcohol and dipropylene glycol with (b) at least 0.1 equivalent of butyl epoxy stearate.

* * * * *